US006050529A

United States Patent [19]

Lin

[11] Patent Number: 6,050,529

[45] Date of Patent: Apr. 18, 2000

[54] FLOWER POT SUPPORT STRUCTURE

[76] Inventor: Ming-Hsien Lin, 58, Ma Yuan West St., Taichung, Taiwan

[21] Appl. No.: 09/236,022

[22] Filed: Jan. 22, 1999

[51] Int. Cl.[7] ..... F16L 3/00

[52] U.S. Cl. ..... 248/121; 248/150; 248/125.3; 211/195; 211/85.23; 211/85; 47/39

[58] Field of Search ..... 248/121, 150, 248/146, 125.3, 163.2, 166, 165, 434, 170, 176.1; 211/195, 85.23, 85; 47/39, 67

[56] References Cited

U.S. PATENT DOCUMENTS

| | | | |
|---|---|---|---|
| 617,090 | 1/1899 | Freese | 211/85 |
| 1,724,385 | 8/1929 | Weston | 248/150 |
| 1,779,788 | 10/1930 | Weston | 211/85 |
| 1,860,879 | 3/1932 | Weston | 248/150 |
| 1,929,136 | 10/1933 | Bertels | 248/150 |
| 2,148,548 | 2/1939 | Gregory | 211/85 |
| 2,591,362 | 4/1952 | Koch | 248/150 |

*Primary Examiner*—Leslie A. Braun
*Assistant Examiner*—Kimberly T. Wood

[57] ABSTRACT

A flower pot support structure includes two front upright bars, a rear upright bar, an upper end pot ring, two upper connecting plates, two lateral end pot rings, a lower pot ring, and a lower connecting frame. The front upright bars are erected apart from each other in a parallel relationship. Each front upright bar has securing holes formed at an intermediate section thereof, and an oblique support bar connected to a lower section thereof. The rear upright bar is erected behind the front upright bars and is also formed with securing holes at an intermediate section thereof. An operating handle is fixedly secured on the rear upright bar above the securing holes, whereas an oblique support bar is connected to a lower section thereof. The upper end pot ring is mounted at a top end of the flower pot support. The upper connecting plates are bent plates that straddle the inner sides of upper sections of the front upright bars and the two sides of an upper section of the rear upright bar. The label plate is pivotally secured between inner sides of the upper sections of the front upright bars. The lateral end pot rings are connected to an intermediate section of the flower pot support at the left and right sides respectively. The lower end pot ring is mounted at a lower section of the flower pot support and has an inverted L-shaped extension plate provided at a rear end thereof. The lower connecting frame is a generally J-shaped bar assembled to a bottom end of the flower pot support.

1 Claim, 6 Drawing Sheets

FLOWER POT SUPPORT STRUCTURE

BACKGROUND OF THE INVENTION

The present invention relates to a flower pot support, more particularly to a flower pot support that can hold a plurality of flower pots in a stable manner, and that can be folded in an easy and quick manner to facilitate storage.

SUMMARY OF THE INVENTION

A primary object of the present invention is to provide a flower pot support structure that can hold a plurality of flower pots, in which flower pots can be arranged at upper and lower ends, and both sides of the flower pot support in a three-dimensional arrangement. When the flower pot support is extended, a retaining notch of an operating handle at an upper section of the flower pot support engages a retaining hook, and a locking notch of a locking plate at a lower end of the flower pot support engages a hooking rod to cooperatively ensure that the flower pot support can stand firmly and stably on the ground.

Another object of the present invention is to provide a flower pot support structure that can be closed in an easy and quick manner, in which the user may press an operating handle with a single hand to cause a retaining notch disengage from a retaining hook, and move a locking plate upwardly with the other hand so that a locking notch disengages from a hooking rod. Next, by pulling a rear upright bar upwardly using the operating handle, front upright bars are caused to displace downwardly and rearwardly toward the rear upright bar so that they can be closed in a compact size to facilitate storage.

BRIEF DESCRIPTION OF THE DRAWINGS

The foregoing and other features and advantages of the present invention will be more clearly understood from the following detailed description and the accompanying drawings in which.

DETAILED DESCRIPTION OF THE PREFERRED EMBODIMENT

Figure 1:
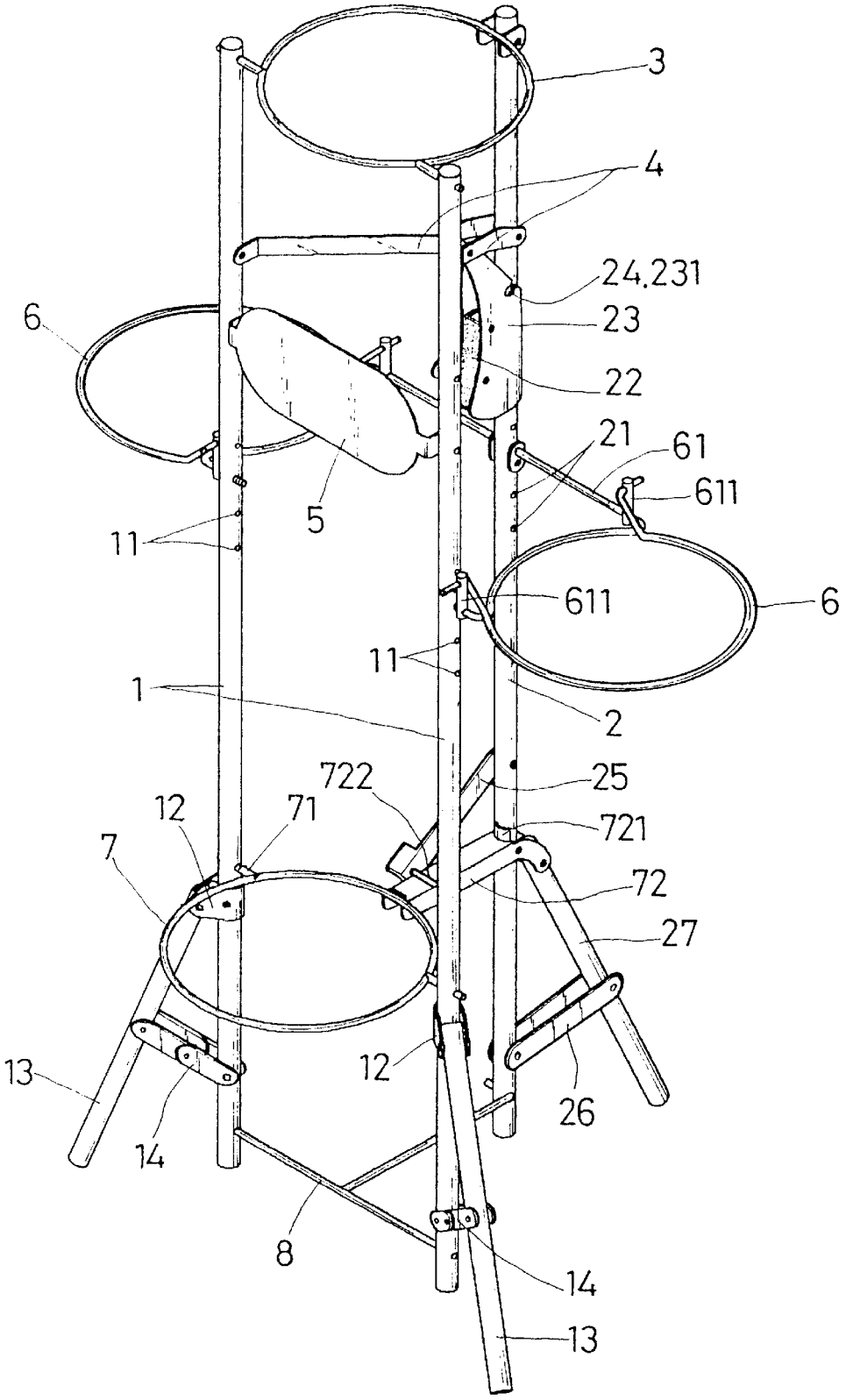
FIG. 1 is a perspective assembled view of the present invention.
Figure 2:
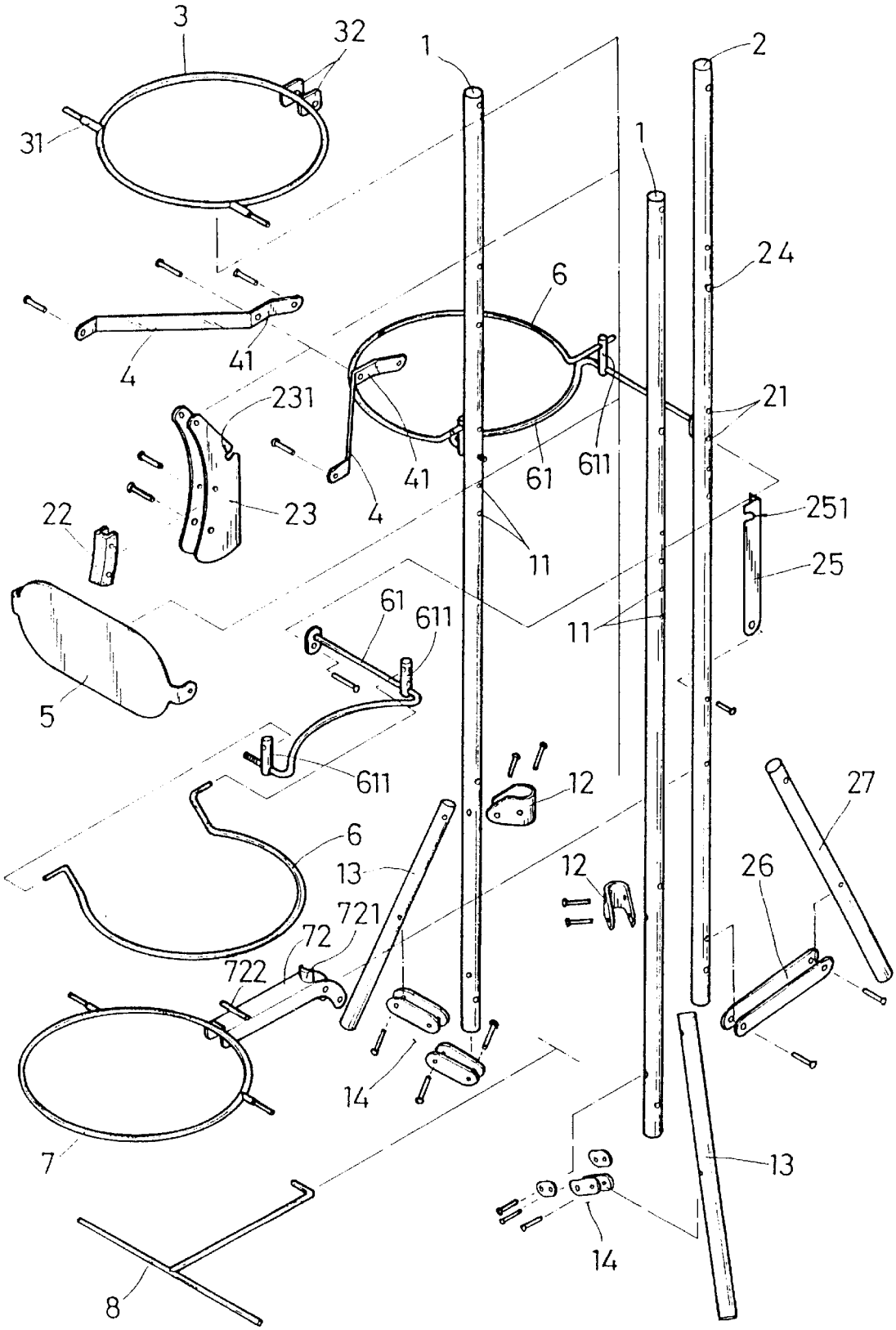
FIG. 2 is a perspective exploded view of the present invention.

With reference to FIGS. 1 and 2, a flower pot support according to the present invention comprises two front upright bars 1, a rear upright bar 2, an upper end pot ring 3, two upper connecting plates 4, a label plate 5, two lateral end pot rings 6, a lower end pot ring 7, and a lower connecting support 8.

The two front upright bars 1 are spaced apart from each other in a parallel relationship, and have an intermediate section formed with a plurality of securing holes 11 at corresponding positions. A pivot seat 12 is mounted on a lower section of each front upright bar 1. An oblique support bar 13 has a top end pivotally secured to the pivot seat 12. An intermediate section of the oblique support bar 13 is connected to the respective one of the front upright bars 1 by two-stage support plates 14.

The rear upright bar 2 is erected behind and between the two front upright bars 1 in a parallel relationship thereto. The rear upright bar 2 has an intermediate section formed with a plurality of securing holes 21 corresponding to the securing holes 11 of the front upright bars 1. An operating handle 23 internally provided with a hand protecting plate 22 is fixedly disposed above the plurality of securing holes 21. The operating handle 23 has a bent at an outer edge thereof, a retaining notch 231 being formed at the bent for engaging a retaining hook 24. A locking plate 25 has a top end pivotally connected to the rear upright bar 2 below the plurality of securing holes 11 at a suitable position. The other end of the locking plate 25 is formed with a locking notch 251. A lower section of the rear upright bar 2 is connected to an intermediate section of an oblique support bar 27 by means of support plates 26.

The upper end pot ring 3 is an annular frame structure that is disposed among top ends of the front upright bars 1 and the rear upright bar 2. The upper end pot ring 3 has pivot pins 31 projecting in opposite directions from a front edge thereof to correspond to the direction of erection of the front upright bars 1, and a pair of spaced-apart pivot plates 32 provided at a rear edge thereof to correspond to the position of the rear upright bar 2.

The two upper connecting plates 4 are bent plates that include a horizontal section 41, and are provided to straddle inner sides of the upper sections of the two front upright bars 1 and both sides of the upper section of the rear upright bar 2. The inner sides of the horizontal sections 41 of the upper connecting plates 4 allow pivotal connection of the upper end of the operating handle 23 thereto.

The label plate 5 is pivotally provided on the inner sides of the upper sections of the two front upright bars 1, adapted for labeling purposes.

The two lateral end pot rings 6 each include a frame portion that is substantially two thirds of a circle and has two end portions, and a side frame 61 that has two bent portions and two ends that are insertable into corresponding securing holes 11, 21 of the front upright bars 1 and the rear upright bar 2. The side frame 61 has an upright post 611 provided at each of the bent portions. The end portions of the frame portion are pivotally at upper ends of the upright posts 611 of the side frame 61.

The lower end pot ring 7 is an annular frame disposed among lower ends of the two front upright bars 1 and the rear upright bar 2. The lower end pot ring 7 includes two pivot pins 71 projecting in opposite directions at a rear edge thereof to correspond to the direction of erection of the two front upright bars 1. Between the two pivot pins 71 a generally inverted L-shaped extension plate 72 extends rearwardly from the lower end pot ring 7. The extension plate 72 has a stop plate 721 extending upwardly from an upper end of a bent portion thereof to fit with the rear upright bar 2. The extension plate 72 further has a rear end to which a top end of the oblique support bar 27 is pivotally connected. A hooking rod 722 is further provided at an upper end of a front section of the extension plate 72, which is retainable in the locking notch 251 of the locking plate 25.

The lower connecting frame 8 is a substantially J-shaped bar that is disposed among bottom ends of the two front upright bars 1 and the rear upright bar 2.

Figure 3:
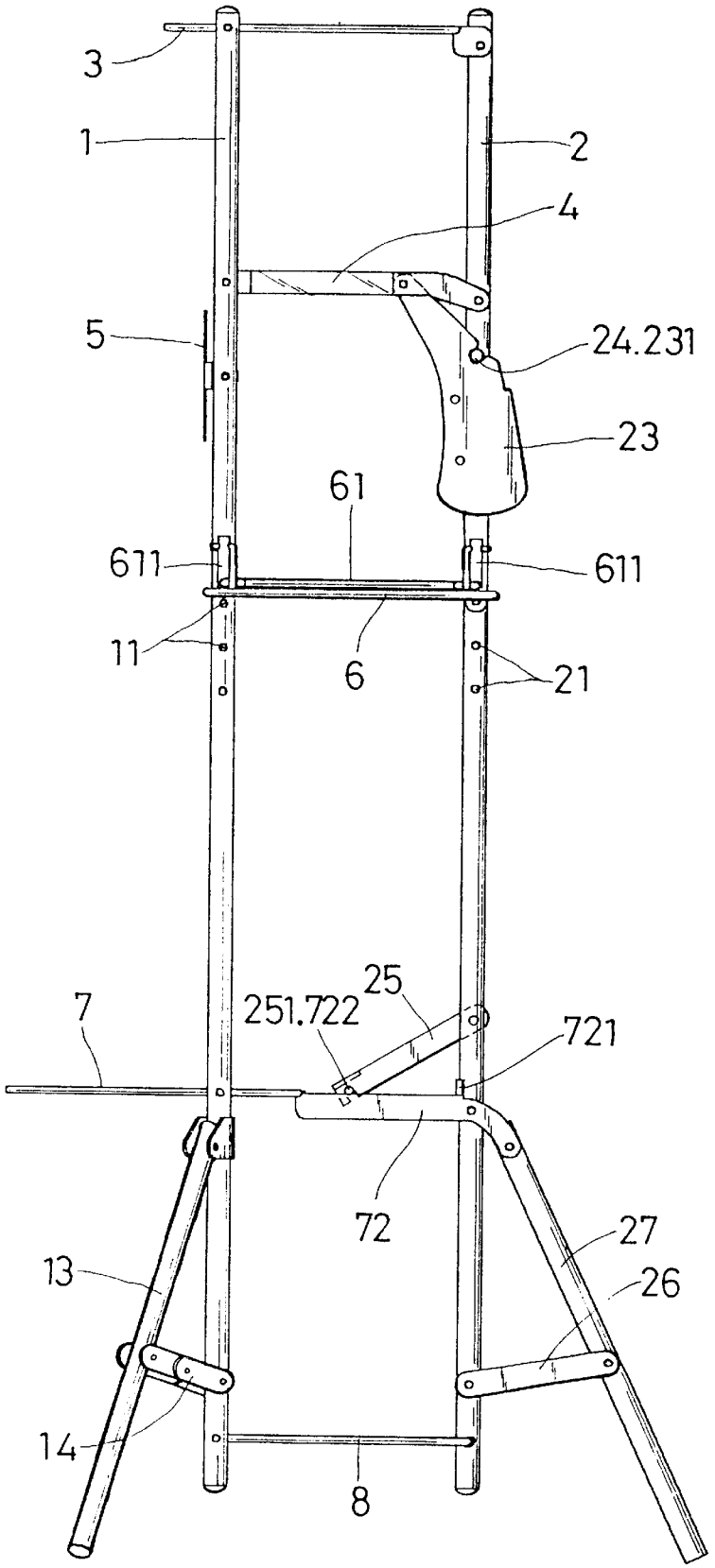
FIG. 3 is a front elevation of the present invention.
Figure 4:
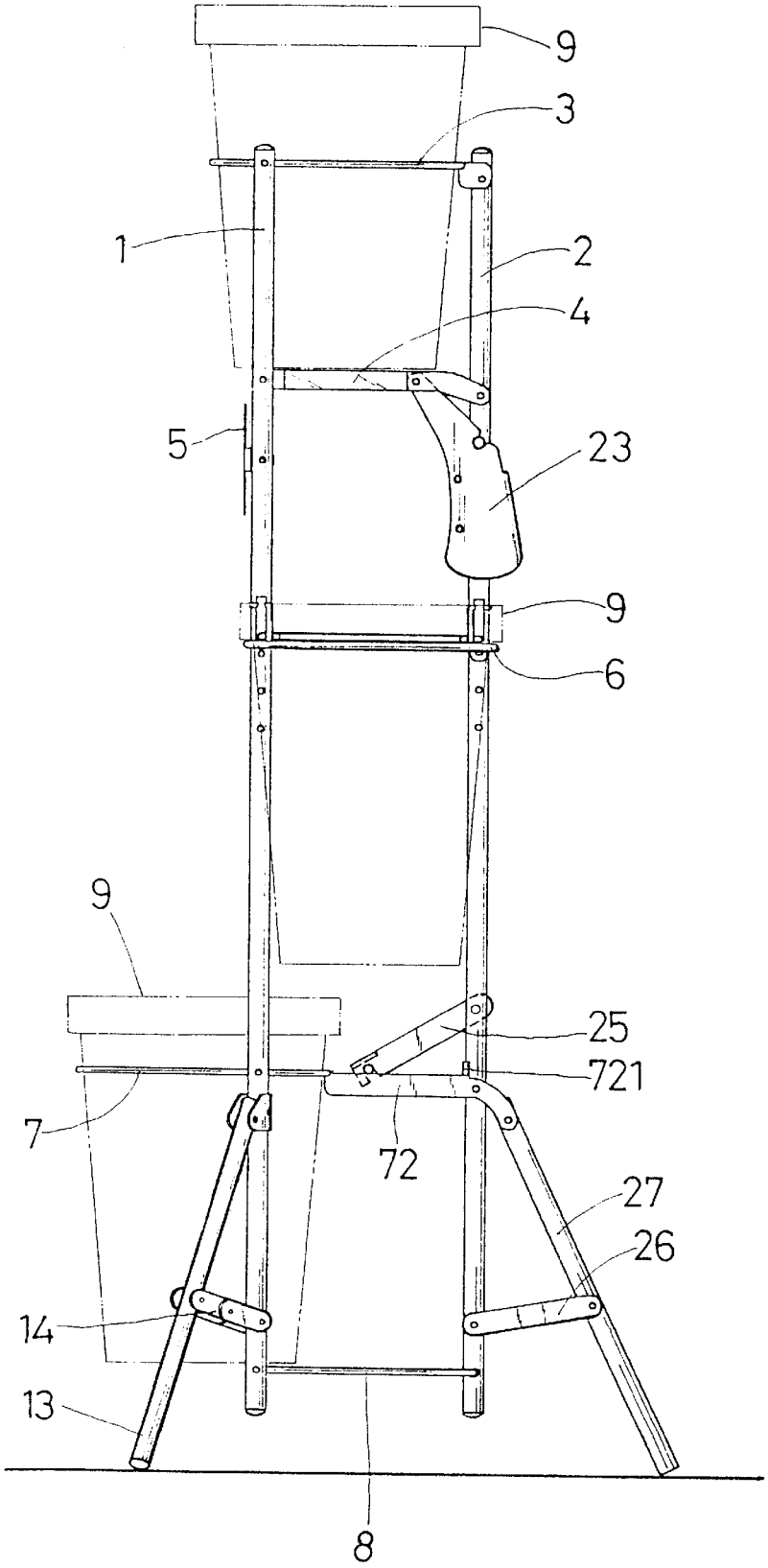
FIG. 4 is a front elevation of the present invention in a state of use.

Referring to FIGS. 1, 3 and 4, after assembly, the two front upright bars 1 and the rear upright bar 2 form a flower pot support supported on the ground at three points. The oblique support bars 13, 24 provide an increased supporting area. The engagement of the retaining hook 24 with the retaining notch 231 of the operating handle 23, and that of the hooking rod 722 with the retaining notch 251 of the locking plate 25 enable the front upright bars 1 and the rear upright bar 2 to stand more stably on the ground. Pots 9 can be placed into the upper end pot ring 3, the lateral end pot rings 6, and the lower end pot ring 7 in a three-dimensional arrangement.

Figure 5:
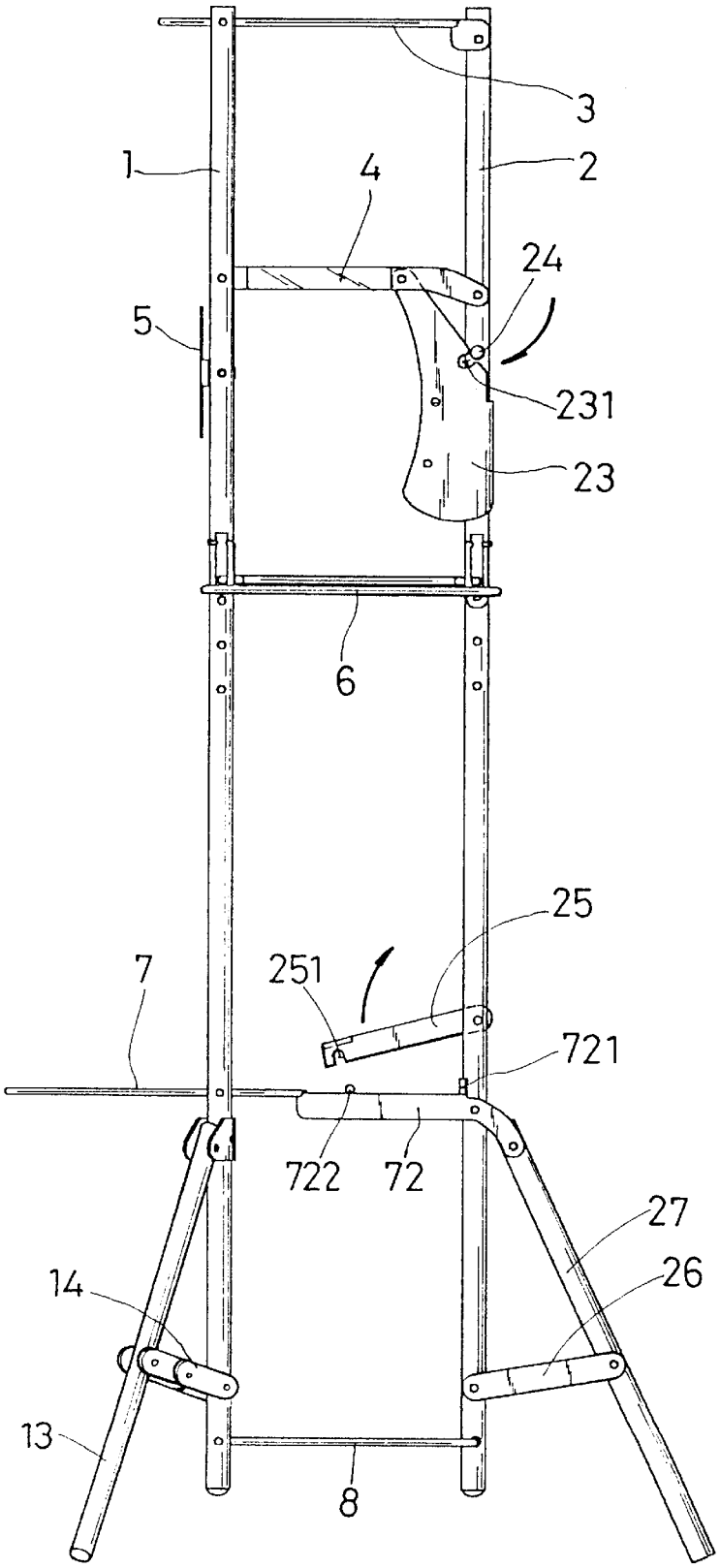
FIG. 5 is a schematic view of the present invention, illustrating closing of the flower pot support.
Figure 6:
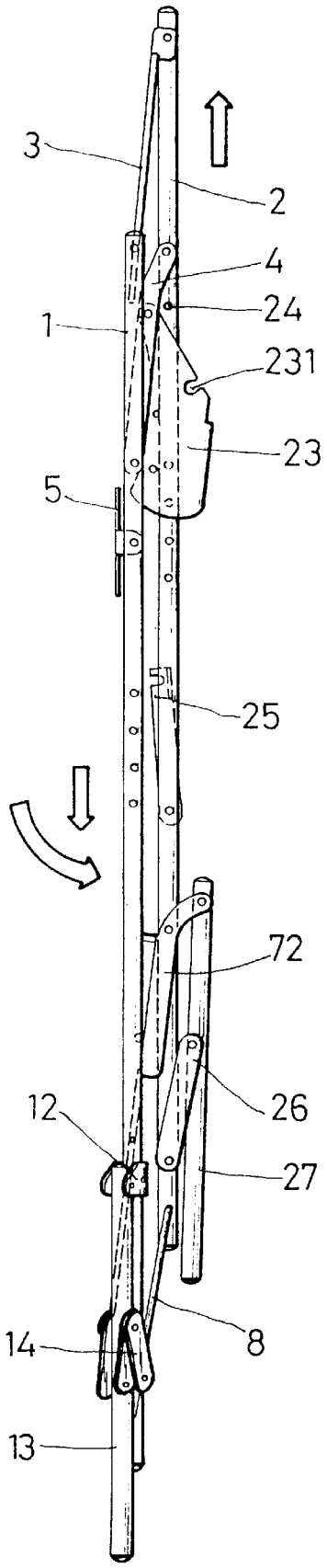
FIG. 6 is a side view of the present invention in a closed state.

When closing the flower pot support of the present invention, referring to FIGS. 5 and 6, the user firstly press a lower section of the operating handle 23 with a single hand so that the retaining notch 231 disengages from the retaining hook 24. The user then uses the other hand to move the locking plate 25 upwardly so that the locking notch 251 disengages from the hooking rod 722 of the extension plate 72. Next, by pulling the rear upright bar 2 using the operating handle 23, the front upright bars 1 will, in response to the upward displacement of the rear upright bar 2, turn and displace downwardly, and move rearwardly to gradually close upon the rear upright bar 2. When the front upright bars 1 are closed to the rear upright bar 2, displacement thereof will stop. It can therefore be appreciated that the flower pot support of the present invention can be closed in a compact size to facilitate storage thereof.

To sum up, the flower pot support has the following advantages:

1. The flower pot support of the present invention allows placement of several flower pots in a three-dimensional arrangement to enhance its economic value.
2. When extended, the front upright bars and rear upright bar can stand uprightly on the ground in a stable manner by means of the retaining notch 231 of the operating handle 23 engaging the retaining hook 24, as well as the locking notch 251 of the locking plate 25 engaging the hooking rod 722.
3. The flower pot support of the present invention is easy and quick to close to facilitate storage. The user may press the operating handle 23 with a single hand to cause the retaining notch 231 disengage from the retaining hook 24, and move the locking plate 25 upwardly with the other hand so that the locking notch 251 disengages from the hooking rod 722. Next, by pulling the rear upright bar 2 upwardly using the operating handle 23, the front upright bars 1 are caused to displace downwardly and rearwardly toward the rear upright bar 2 so that they can be closed in a compact size to facilitate storage.
4. The positions of the two lateral end pot rings 6 on the flower pot support of the present invention are adjustable due to the arrangement of the securing holes 11, 21, so that flower pots 9 can be placed in different arrangements.
5. As the operating handle 23 is internally provided with a hand protecting plate, the user's hand can be protected from harm during closing or extending of the flower pot support.
6. The stop plate 721 projecting upwardly from the bent portion of the inverted L-shaped extension plate 72 enable the flower pot support to stand more stably on the ground.
7. The arrangement of the lower connecting frame 8 enhances the triangular connection of the front upright bars 1 and the rear upright bar 2.

Although the present invention has been illustrated and described with reference to the preferred embodiment thereof, it should be understood that it is in no way limited to the details of such embodiment but is capable of numerous modifications within the scope of the appended claims.

What is claimed is:

1. A flower pot support structure, comprising two front upright bars, a rear upright bar, an upper end pot ring, two upper connecting plates, a label plate, two lateral end pot rings, a lower pot ring, and a lower connecting frame, said front upright bars being spaced apart from each other in a parallel relationship and having an upper section, an intermediate section and a lower section, said intermediate section being formed with a plurality of securing holes at corresponding positions, a pivot seat being mounted on said lower section an oblique support bar having a top end pivotally secured to said pivot seat and an intermediate section connected to the respective one of said front upright bars 1 by two-stage support plates;

said rear upright bar being erected behind and between said front upright bars in a parallel relationship thereto, and having an upper section, an intermediate section, and a lower section, said intermediate section being formed with a plurality of securing holes corresponding to said securing holes of said front upright bars, said rear upright bar having an operating handle fixedly disposed thereon above said securing holes thereof, said operating handle being internally provided with a hand protecting plate and having a bent at an outer edge thereof, a retaining notch being formed at said bent for engaging a retaining hook, said rear upright bar further having a top end of a locking plate pivotally connected thereto below said securing holes thereof at a suitable position, the other end of said locking plate being formed with a locking notch, said lower section of said rear upright bar being connected to an intermediate section of an oblique support bar by means of support plates;

said upper end pot ring being an annular frame structure that is disposed among top ends of said front upright bars and said rear upright bar, said upper end pot ring having two pivot pins projecting in opposite directions from a front edge thereof to correspond to the direction of erection of said front upright bars, and a pair of spaced-apart pivot plates provided at a rear edge thereof to correspond to the position of said rear upright bar;

said two upper connecting plates being bent plates that include a horizontal section, and being provided to straddle inner sides of said upper sections of said front upright bars and both sides of said upper section of said rear upright bar; said inner sides of said horizontal sections of said upper connecting plates allowing pivotal connection of an upper end of said operating handle thereto;

said label plate being pivotally provided on inner sides of said upper sections of said front upright bars, adapted for labeling purposes;

said two lateral end pot rings each including a frame portion that is substantially two thirds of a circle and having two end portions, and a side frame that has two bent portions and two ends that are insertable into corresponding securing holes of said front upright bars and said rear upright bar, said side frame having an upright post provided at each of said bent portions thereof, said end portions of said frame portion being pivotally at upper ends of said upright posts of said side frame;

said lower end pot ring being annular frame disposed among lower ends of said two front upright bars and said rear upright bar, said end pot ring including two pivot pins projecting in opposite directions at a rear edge thereof to correspond to the direction of erection of said front upright bars, a generally inverted L-shaped extension plate extends rearwardly from said lower end pot ring between said two pivot pins, said extension plate having a bent portion and a stop plate extending upwardly from an upper end of said bent portion to fit with said rear upright bar, said extension plate further having a rear end to which a top end of said oblique support bar is pivotally connected, a hooking rod being further provided at an upper end of a front section of said extension plate and being retainable in said locking notch of said locking plate;

said lower connecting frame being a substantially J-shaped bar that is disposed among bottom ends of said front upright bars and said rear upright bar;

said flower pot support allowing placement of a plurality of flower pots and being closeable in a quick and convenient manner to facilitate storage.

* * * * *